US007097596B2

(12) United States Patent
Yang

(10) Patent No.: US 7,097,596 B2
(45) Date of Patent: Aug. 29, 2006

(54) EXERCISE BICYCLE

(75) Inventor: Hsin-Yen Yang, Taichung Hsien (TW)

(73) Assignee: Uniasso Enterprise Co., Ltd., Taichung Hsien (TW)

( * ) Notice: Subject to any disclaimer, the term of this patent is extended or adjusted under 35 U.S.C. 154(b) by 529 days.

(21) Appl. No.: 10/617,175

(22) Filed: Jul. 11, 2003

(65) Prior Publication Data

US 2004/0259694 A1 Dec. 23, 2004

(51) Int. Cl.
*A63B 69/16* (2006.01)

(52) U.S. Cl. ..... 482/57; 482/95

(58) Field of Classification Search ..... 482/51–53, 482/57–65, 95

See application file for complete search history.

(56) References Cited

U.S. PATENT DOCUMENTS 3,309,084 A * 3/1967 Simmons ..... 482/62
3,865,366 A * 2/1975 Stantial ..... 482/57
4,265,447 A * 5/1981 Shafer ..... 482/60
4,477,072 A * 10/1984 DeCloux ..... 482/4
4,561,648 A * 12/1985 Wu ..... 482/65
4,917,394 A * 4/1990 Lin ..... 280/229
5,549,527 A * 8/1996 Yu ..... 482/57
5,643,145 A * 7/1997 Lo et al. ..... 482/57

* cited by examiner

*Primary Examiner*—Stephen R. Crow
(74) *Attorney, Agent, or Firm*—Bacon & Thomas, PLLC

(57) ABSTRACT

An exercise bicycle includes a frame and a driven wheel. The frame has a base, a driven member which has an end pivotably connected to the base, and a contacting portion disposed on the driven member. The driven wheel, which is rotatably connected to the base, includes a rolling face contacted with the contacting portion. When the driven wheel is driven to rotate, the driven member will pivot reciprocatingly on a point where the driven member is connected with the base.

9 Claims, 11 Drawing Sheets

EXERCISE BICYCLE

BACKGROUND OF THE INVENTION

1. Field of the Invention

The present invention relates generally to exercise apparatuses, and more particularly, to an exercise bicycle.

2. Description of the Related Art

Referring to FIG. 1, a conventional indoor exercise bicycle is composed of a main frame 1, a handrail 2, a saddle 3, a transmission set 4, and a resistance device 5. The transmission set 4 includes a pedal 4*a*, a crank 4*b*, a driving wheel (not shown), a driven wheel 4*c*, and a belt (not shown) running on the driving wheel and driven wheel 4*c*. The user keeps pedaling the pedal 4*a* to drive the driving wheel to rotate, and then the driven wheel 4*c* is driven to rotate by the driving wheel via the belt. The resistance device 5 offers an appropriate resistance against the rotation of the driven wheel 4*c*.

Although the user can do lots of pedaling exercise stationarily on the indoor exercise bicycle to strengthen the muscle of the legs by the simulation of riding a bicycle, the exercise bicycle only enables the user to exercise the muscle of the legs.

SUMMARY OF THE INVENTION

The primary objective of the present invention is to provide an improved exercise bicycle which enables the user to do exercise by the simulation of riding a bicycle and a horse.

The secondary objective of the present invention is to provide an improved exercise bicycle which enables the user to exercise the muscle of the legs and the waist at the same time.

The foregoing objectives of the present invention are attained by the exercise bicycle which is composed of a frame and a driven wheel. The frame includes a base, a driven member which has an end pivotably connected to the base, and a contacting portion disposed on the driven member. The driven wheel, which is stationarily rotatably connected to the base and is driven to rotate by an external force, includes a rolling face contacted with the contacting portion for driving the driven member to reciprocatingly pivot to said base when the driven wheel is driven by the external force to rotate.

DETAILED DESCRIPTION OF THE INVENTION

Figure 1:
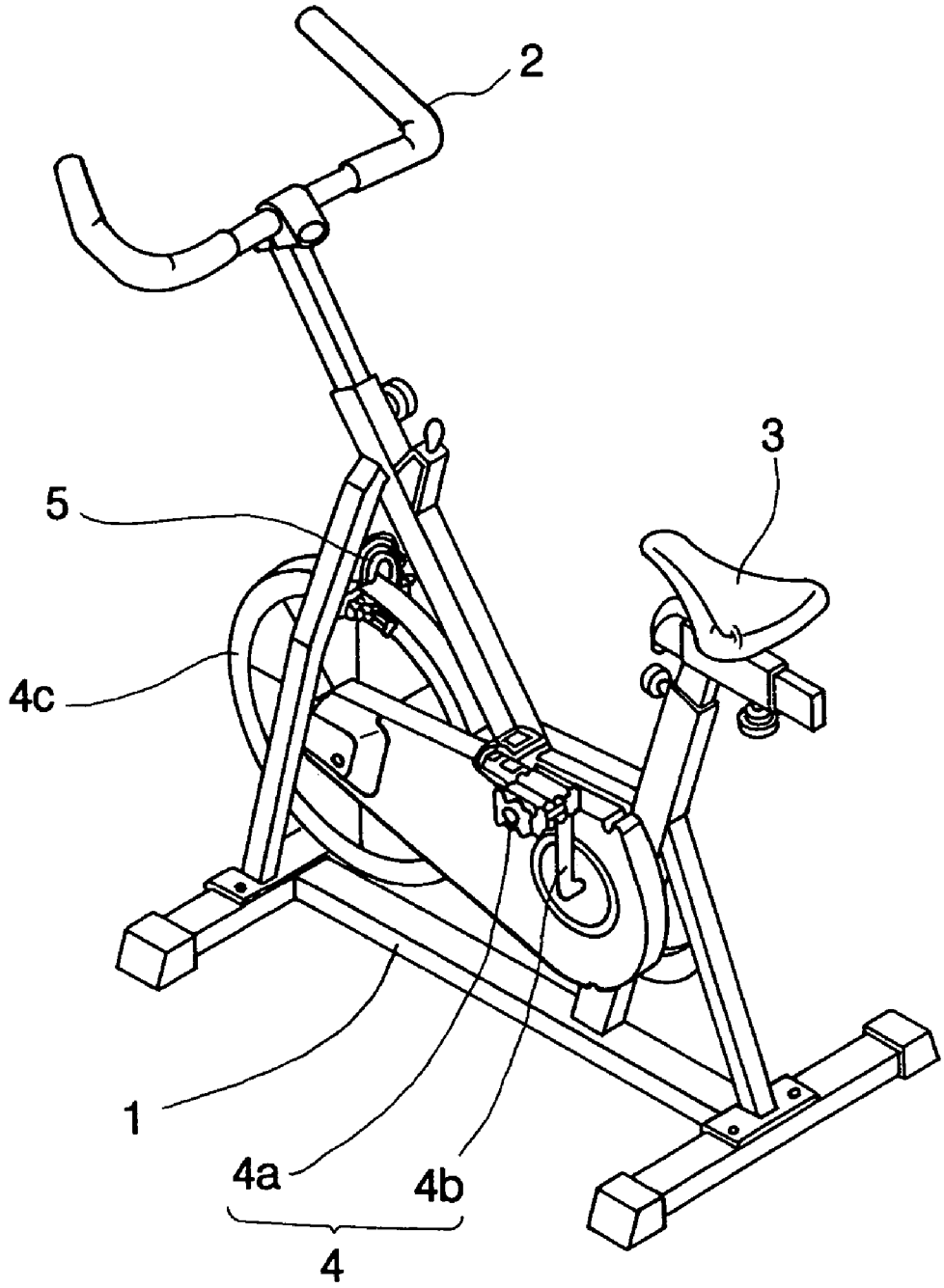
FIG. 1 PRIOR ART
FIG. 1 is a perspective view of a prior art.
Figure 2:
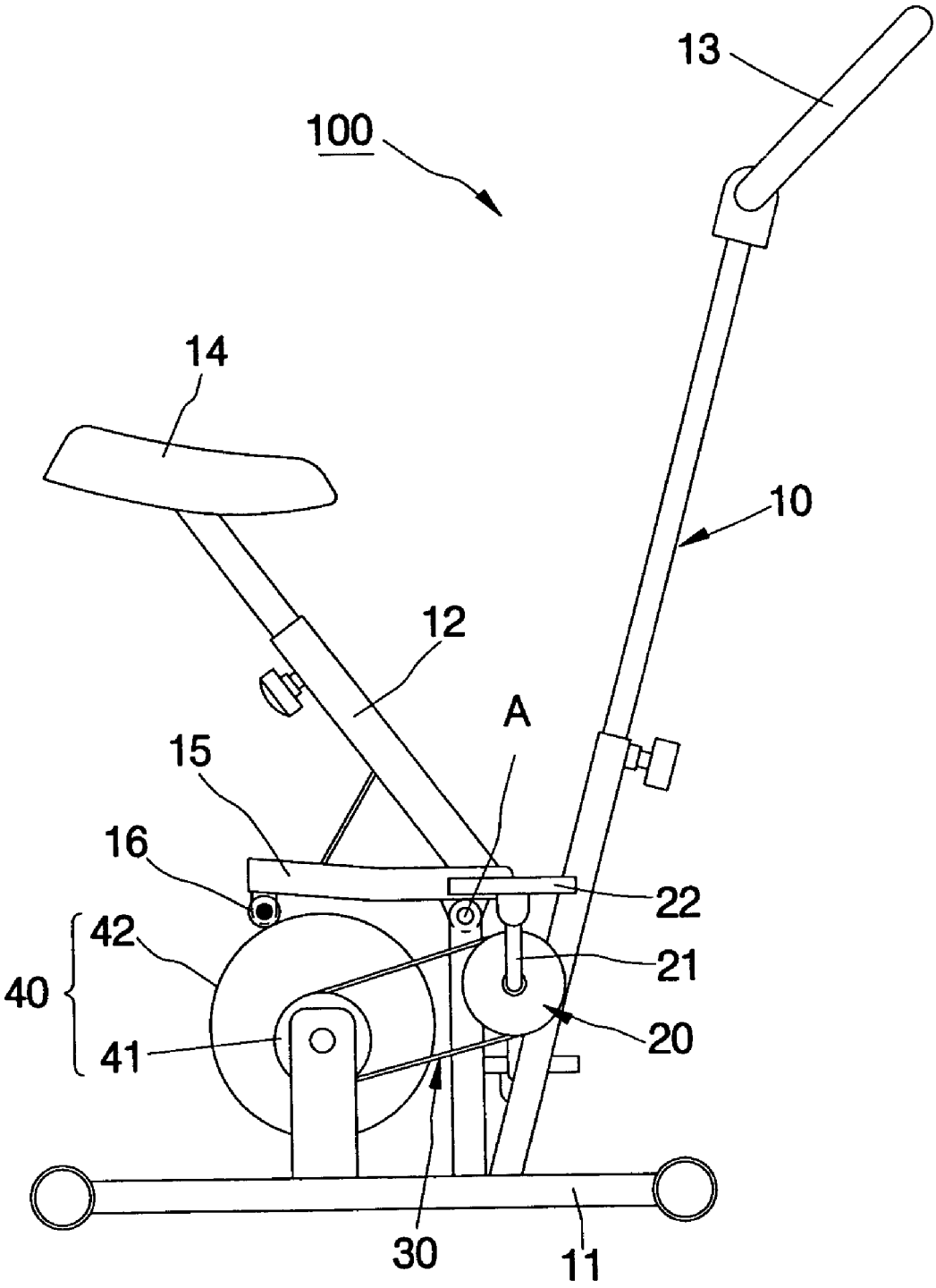
FIG. 2 is a side view of a first preferred embodiment of the present invention.

Referring to FIG. 2, an exercise bicycle 100 constructed according to a first preferred embodiment of the present invention is composed of a frame 10, a driving wheel 20, a belt 30, and a driven wheel embodied as an eccentric wheel 40.

The frame 10 includes a base 11, a driven member 12, and a handrail 13. The base 11 is formed of a plurality of struts connected with one another to stably stand on the ground. The driven member 12 is a rigid rod member, and has a top end thereof connected with a saddle 14 and a bottom end thereof pivotably connected to the base 11 by a pivot A. The handrail 13 is fixedly mounted on the base 11. A linkage bar 15 has one end secured to a bottom end of the driven member 12 and the other end extending towards a rear side of the exercise bicycle 100. A cylindrical roller 16 is rotatably connected with the other end of the linkage bar and is provided with a contacting portion at an outer edge.

The driving wheel 20 is stationarily rotatably connected to the frame 10 and connected with a crank 21 and a pedal 22 on which the user's legs work to drive the driving wheel 20 to rotate.

Figure 3:
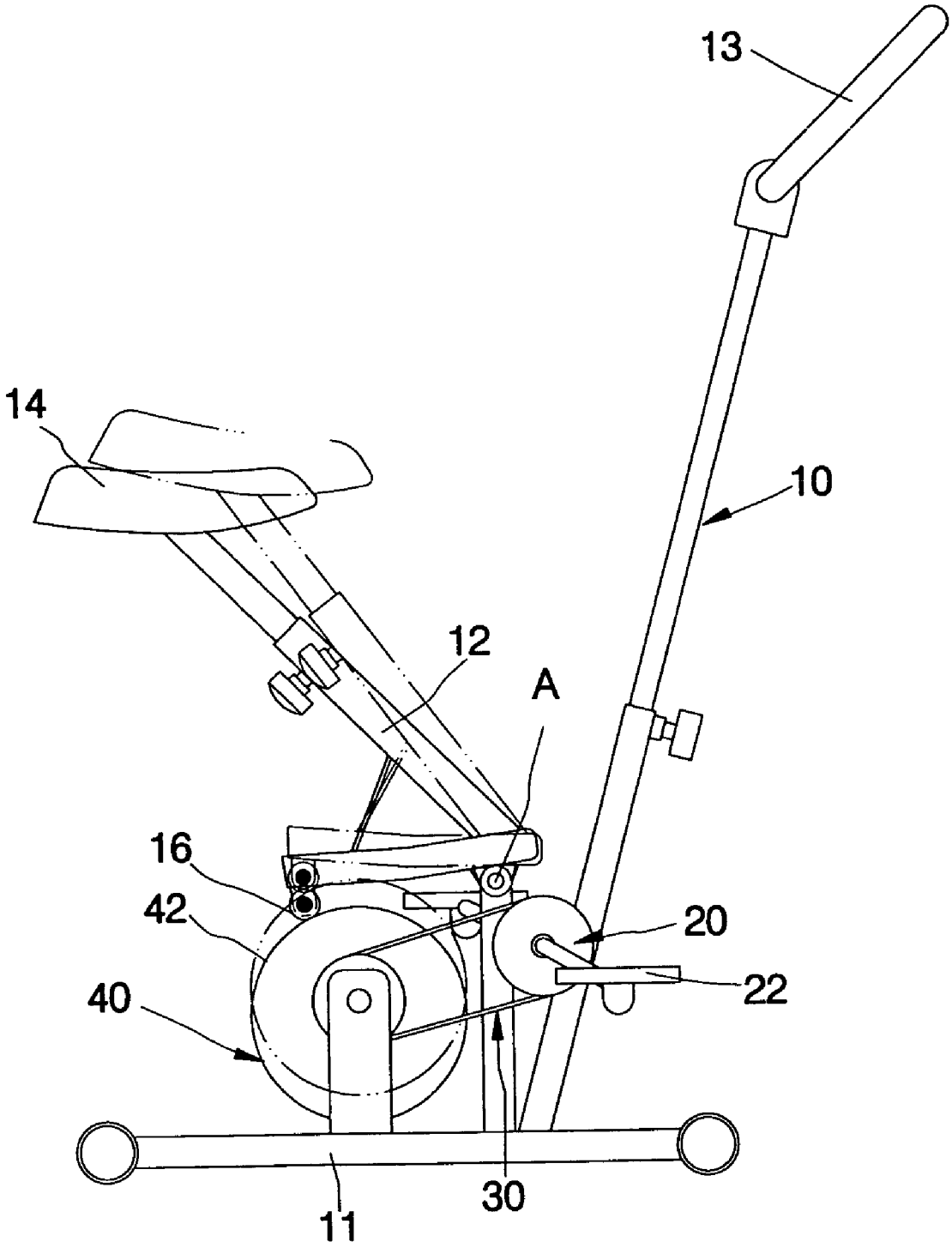
FIG. 3 is a schematic view of the first preferred embodiment of the present invention at work.

The eccentric wheel 40 is rotatably connected to the base 11 to be suspended away from the ground and includes a round axial neck 41 and a rolling face 42. The axial neck 41 is integrally formed on and protrudes from a lateral side of the eccentric wheel. The belt 30 runs on the driving wheel 20 and the axial neck 41. When the driving wheel 20 is driven to rotate, the eccentric wheel 40 is driven to rotate by the driving wheel 20 via the belt 30. The rolling face 42 of the eccentric wheel 40 keeps touching the contacting portion of the roller 16 and a rolling path is formed while the rolling face 42 moves along with the eccentric wheel 40. The rolling path causes a reciprocating movement of the roller so as to push the driven member 14 to reciprocatingly pivot on the pivot A. In other words, the reciprocating movement of the roller 16 drives the driven member 12 and the saddle 14 to synchronously pivot reciprocatingly, as shown in FIG. 3.

In operation, the user operates the exercise bicycle 100 by the legs pedaling the pedal 22, and further at the same time, the driven member 12 and the saddle 14 will be driven to pivot reciprocatingly within a predetermined range, thereby enabling the user's hip to be lifted and lowered like riding a horse. Accordingly, the exercise bicycle 100 of the present invention enables the user to do the exercise by the simulation of riding a bicycle and a horse, and further exercises the muscle of the legs and the waist of the user at the same time.

Further, the proportion of the diameter of the driving wheel 20 to the axial neck 41 can be variated to further alter the proportion of the rotational speed of the driving wheel 20 to the eccentric wheel 40. In this embodiment, the proportion of the diameter of the driving wheel 20 to the eccentric wheel 40 is 1:1, i.e. while the driving wheel 20 is rotated for one round, the eccentric wheel 40 is also rotated for one round, and further the driven member 12 is driven to pivot back and forth for one round.

Figure 4:
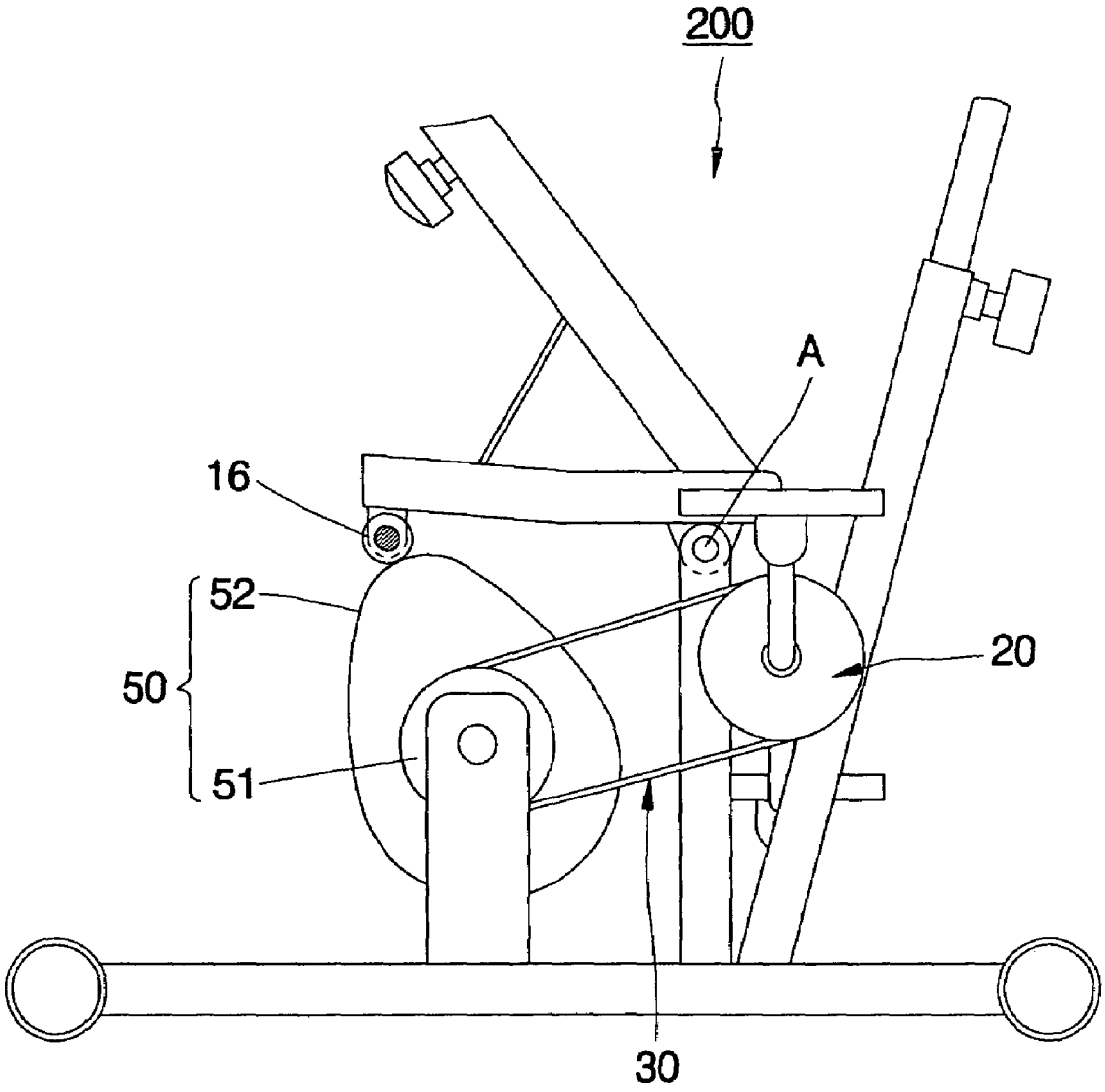
FIG. 4 is a side view of a second preferred embodiment of the present invention.

Referring to FIG. 4, the exercise bicycle 200 constructed according to a second preferred embodiment of the present invention is different from the aforementioned embodiment in that the driven wheel is an elliptical discords cam 50 which includes an axial neck 51 for the belt 30 running on and a rolling face 52 for contacting against the roller 16. When the discords cam 50 is rotated along with the driving wheel 20, it drives the roller 16 to move reciprocatingly so as to further drive the driven member 14 to reciprocatingly pivot on the pivot A.

Figure 5:
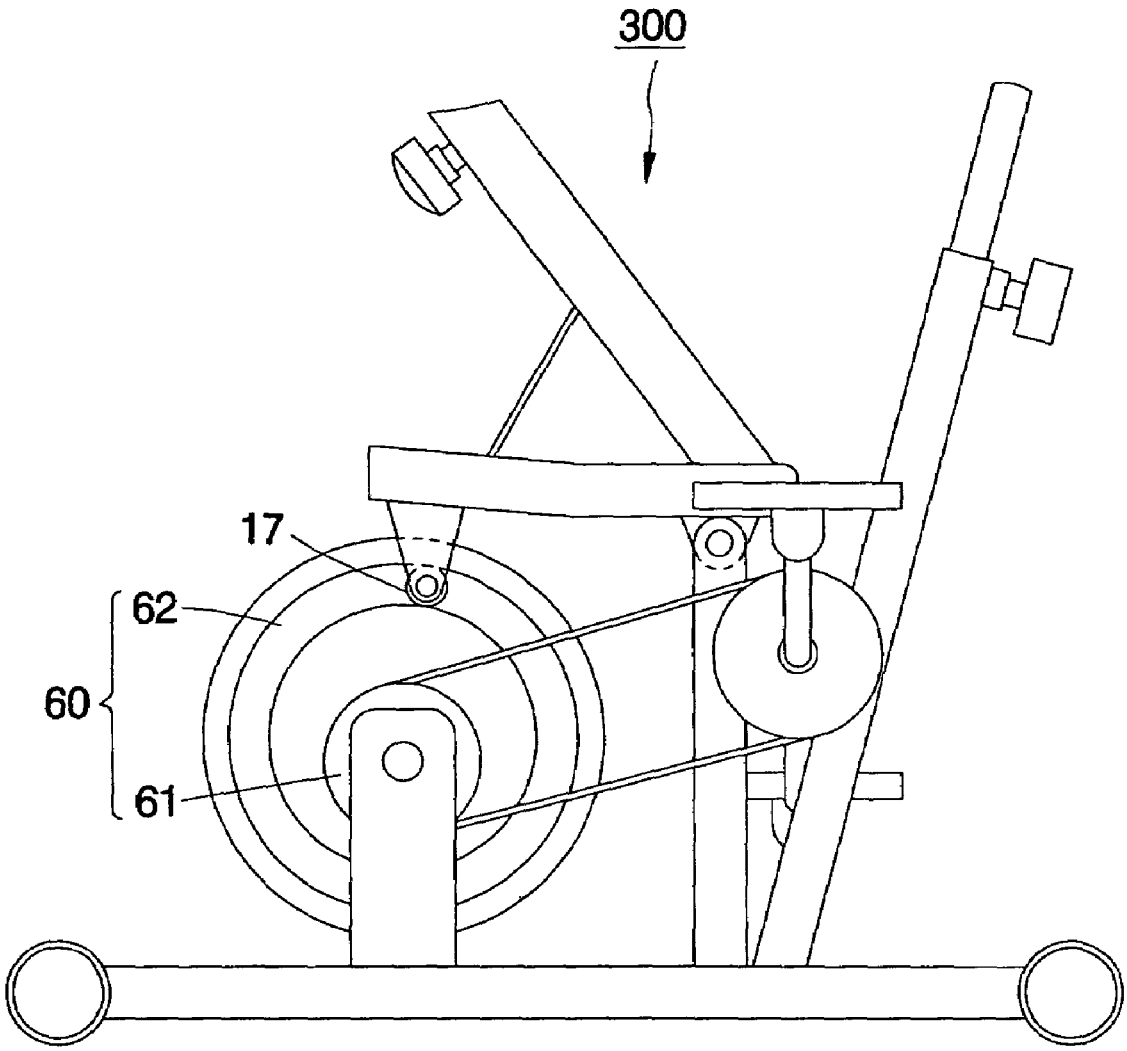
FIG. 5 is a side view of a third preferred embodiment of the present invention.
Figure 6:
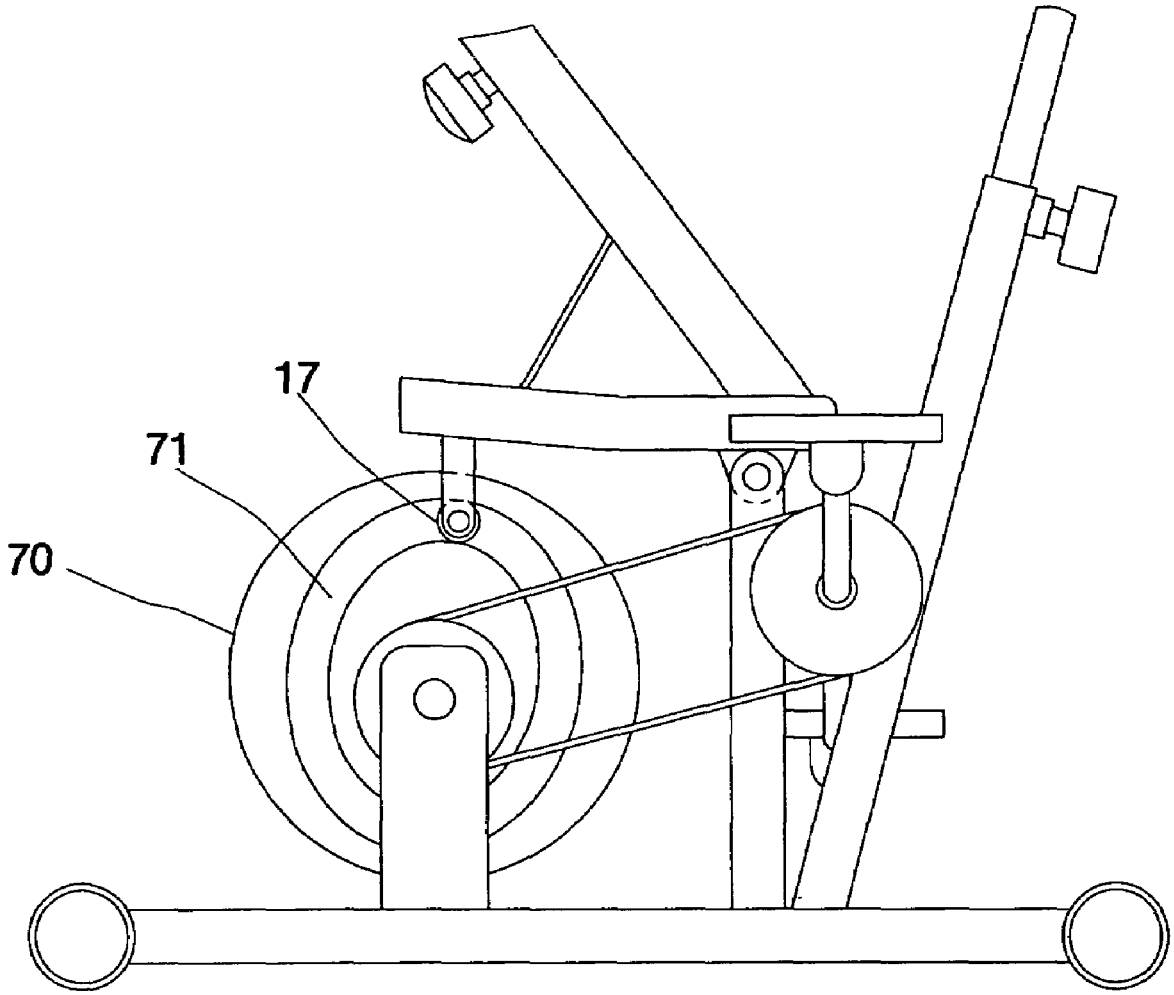
FIG. 6 is a side view of the third preferred embodiment of the present invention, showing an alternative form of a face cam.

Referring to FIG. 5, the exercise bicycle 300 constructed according to a third preferred embodiment of the present invention is different from the aforementioned embodiment in that the driven wheel is a face cam 60 which includes a round axial neck 61 and an annular ditch 62 recessed thereon. The roller 17 is received in and moved along with the annular ditch 62. As shown in FIG. 6, the ditch 71 of the face cam 70 is alternatively elliptical.

Figure 7:
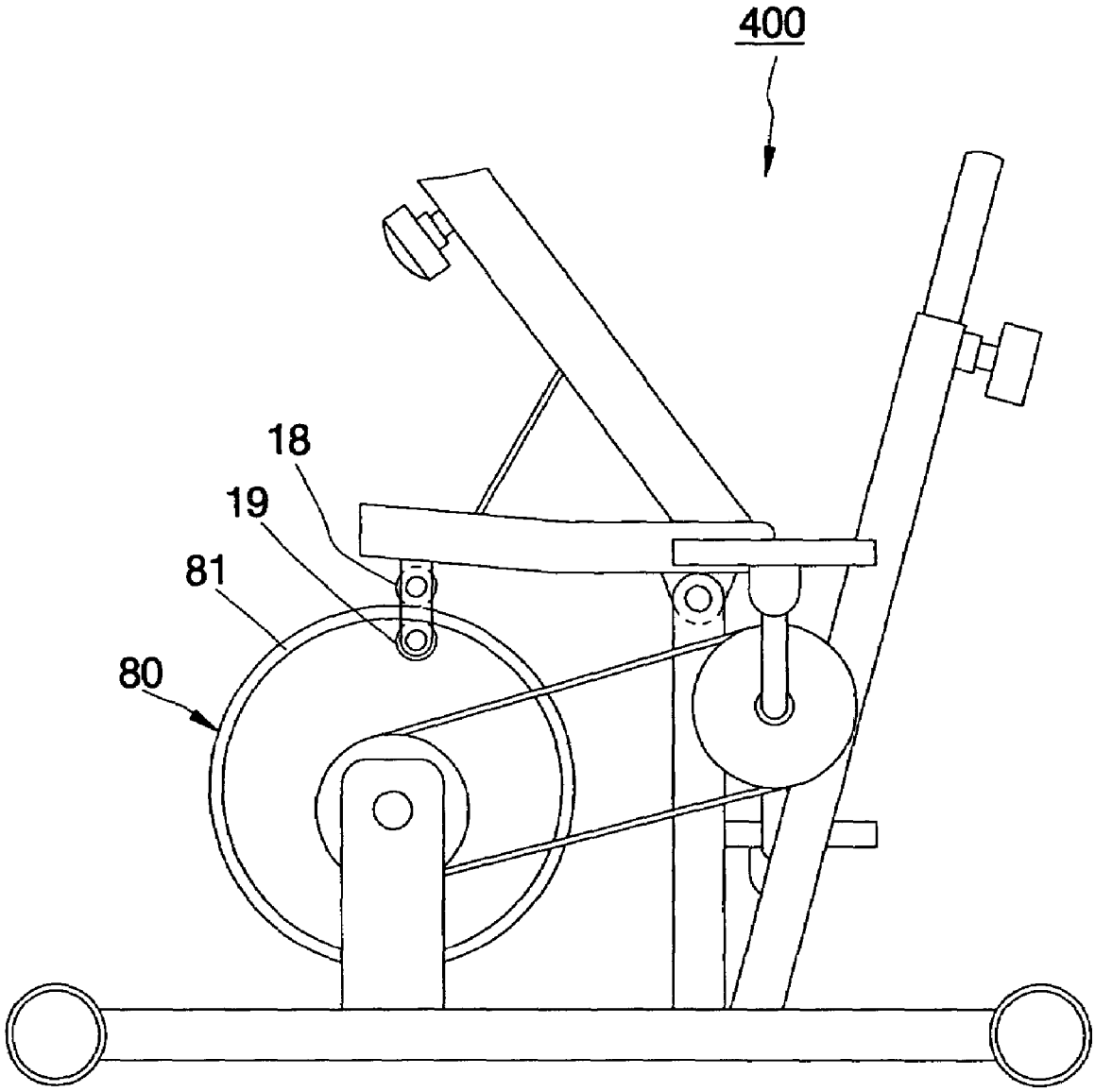
FIG. 7 is a side view of a fourth preferred embodiment of the present invention.

Referring to FIG. 7, the exercise bicycle 400 constructed according to a fourth preferred embodiment is different from the aforementioned embodiments in that the exercise bicycle 400 includes a ribbed cam 80 and two rollers 18 and 19. The ribbed cam 80 is provided with an annular rib 81 around an outer edge thereof. The two rollers 18 and 19 respectively engage against an inner periphery and an outer periphery of the rib 81 to clamp the rib 81.

Figure 8:
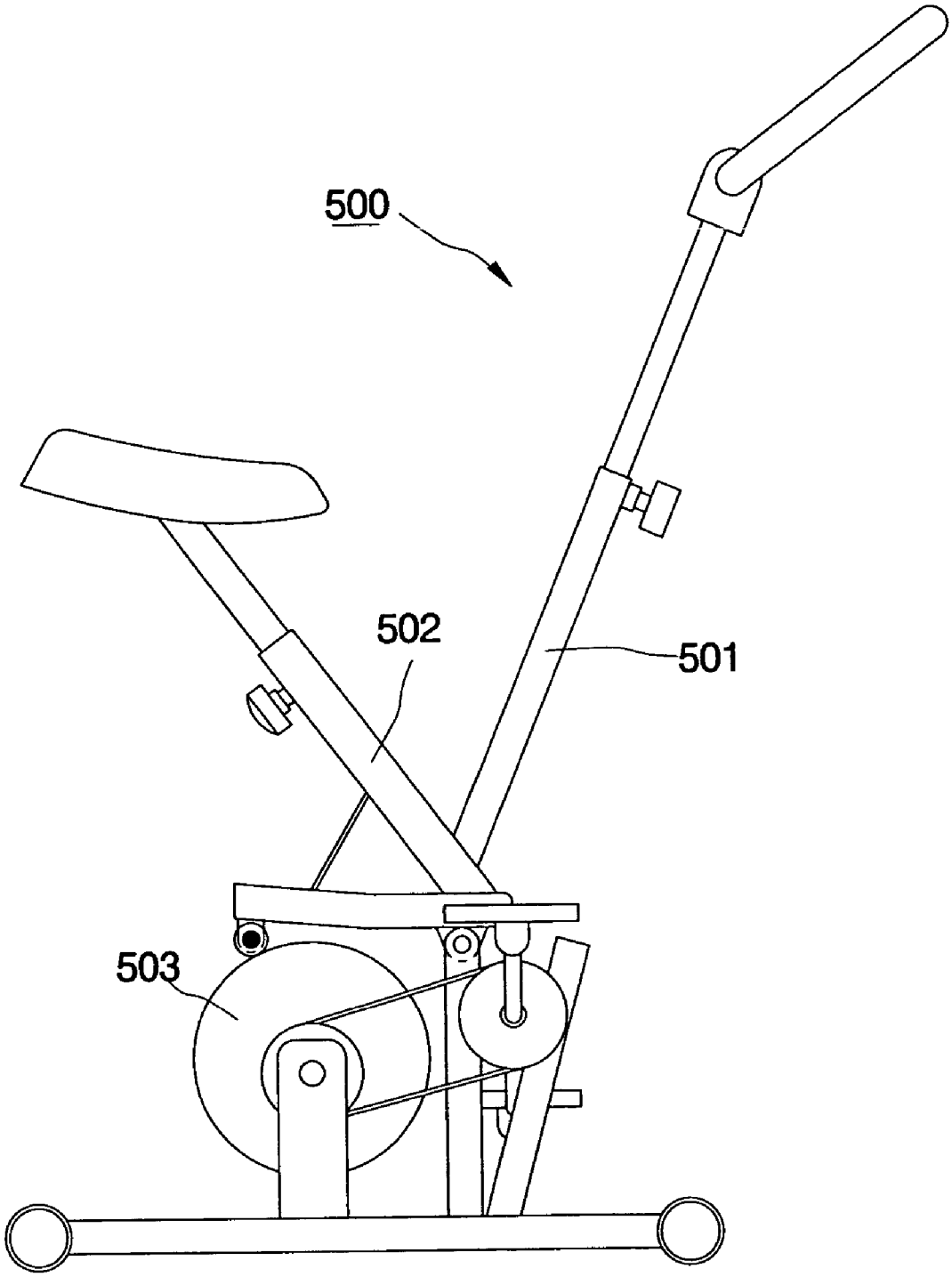
FIG. 8 is a side view of a fifth preferred embodiment of the present invention.

Referring to FIG. 8, the exercise bicycle 500 constructed according to a fifth preferred embodiment is different from the aforementioned embodiments in that the handrail 501 is directly fixedly connected to the bottom end of the driven member 502 at an end thereof and is driven to pivot reciprocatingly by the driven wheel 503, such that the driven member 502 pivots reciprocatingly along with the handrail 501.

Figure 9:
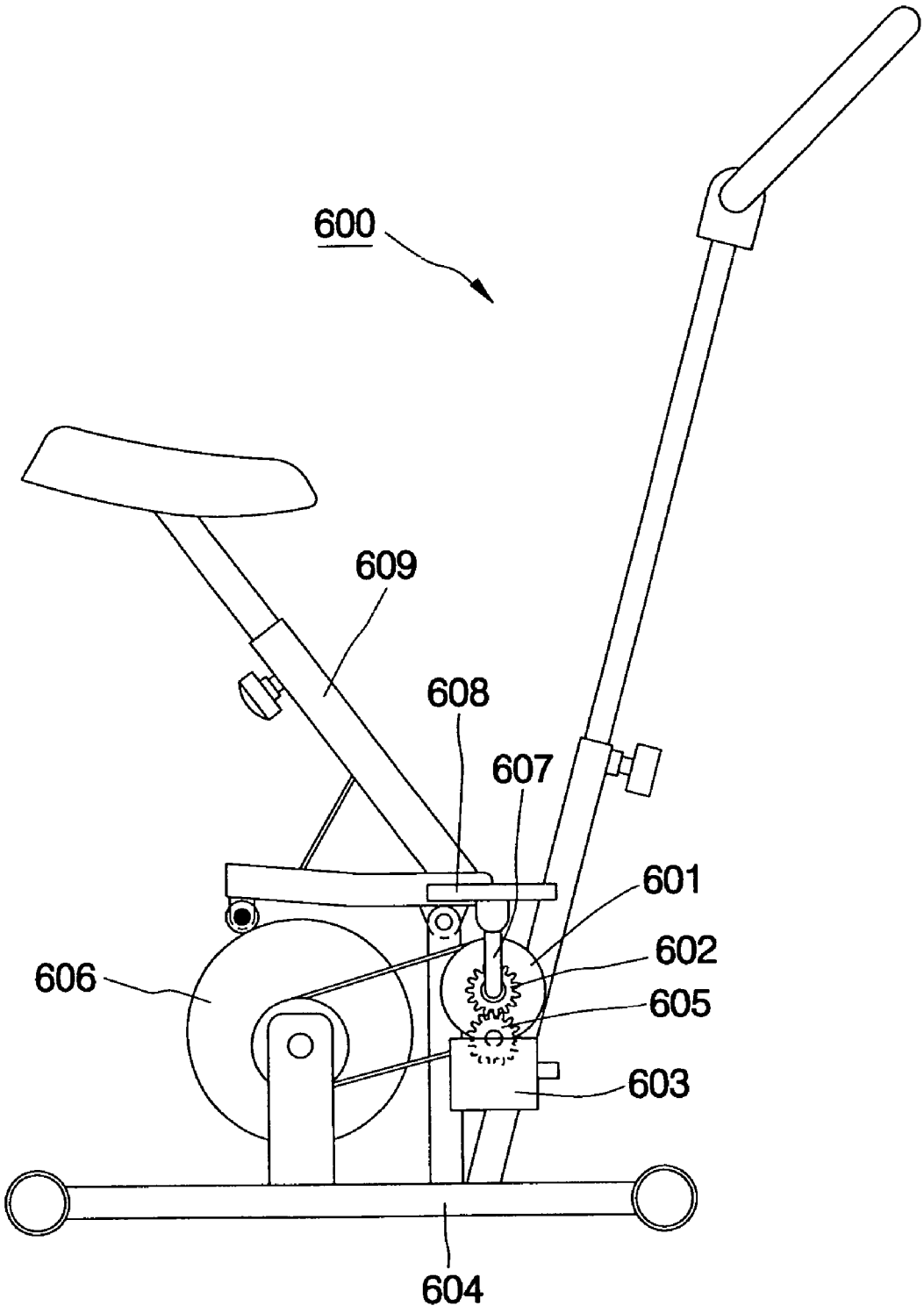
FIG. 9 is a side view of a sixth preferred embodiment of the present invention.

Referring to FIG. 9, the exercise bicycle 600 constructed according to a sixth preferred embodiment is different from the aforementioned embodiments in that an active gear 602 is mounted at a side of the driving wheel 601 and a motor 603 is fixedly mounted to the frame 604. When the motor 603 is operated, a passive gear 605 in mesh with the active gear 602 is driven to rotate and further to drive the driving wheel 601 and the driven wheel 606 to rotate, and meanwhile, to forcibly drive the crank 607 and the pedal 608 to rotate, such that the driven member 609 is driven to pivot reciprocatingly. Hence, the exercise bicycle 600 forces the user's legs to pedal and simulate the horse riding, which is adapted for people whose bodies need rehabilitation.

Figure 10:
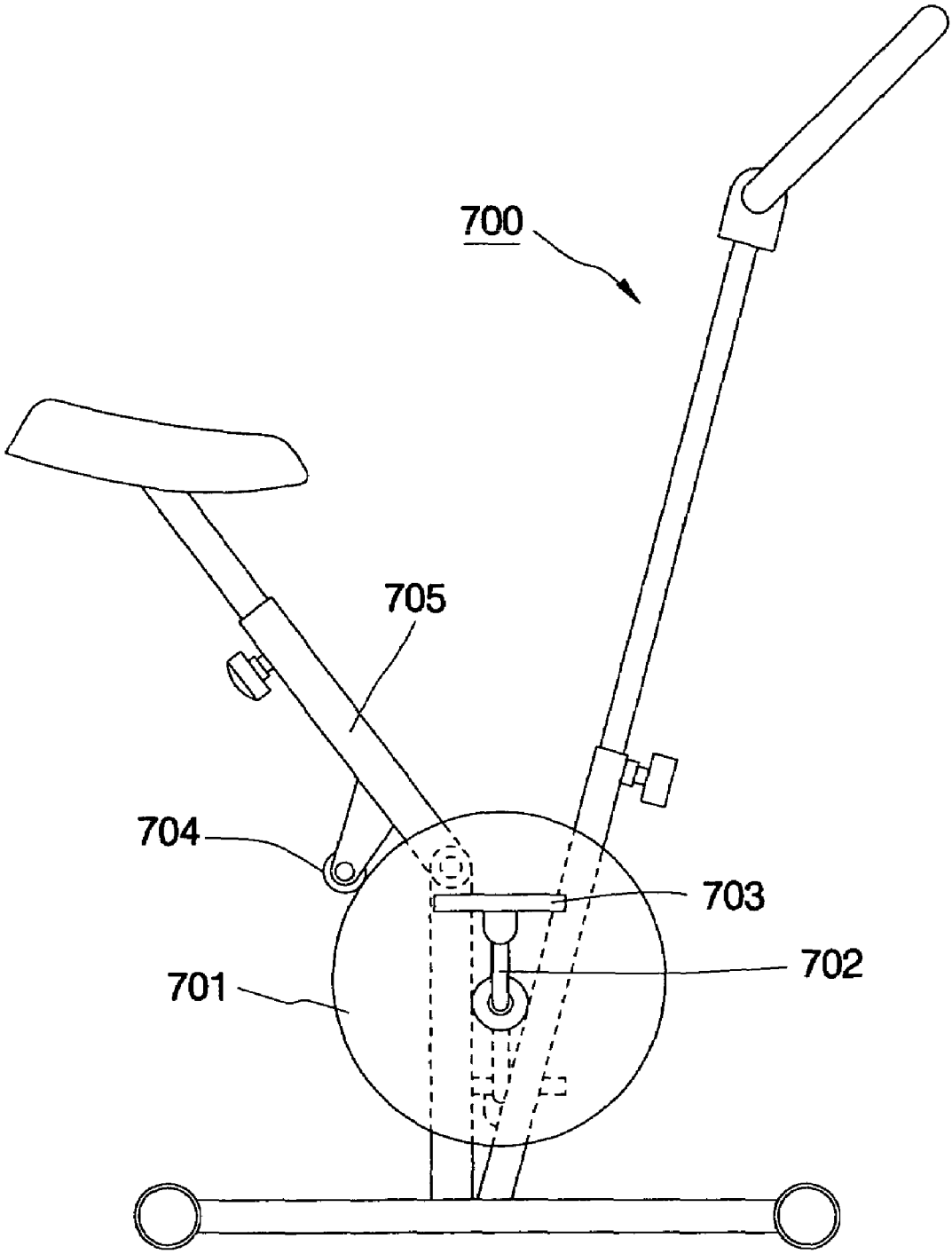
FIG. 10 is a side view of a seventh preferred embodiment of the present invention.

Referring to FIG. 10, the exercise bicycle 700 constructed according to a seventh preferred embodiment is different from the aforementioned embodiments in that the driving wheel and the belt are not included in the exercise bicycle 700. The driven wheel 701 embodied as an eccentric wheel is directly connected with the crank 702 and the pedal 703 and is rotated by the user's pedaling to drive the driven member 705 to pivot reciprocatingly via the roller 704.

Figure 11:
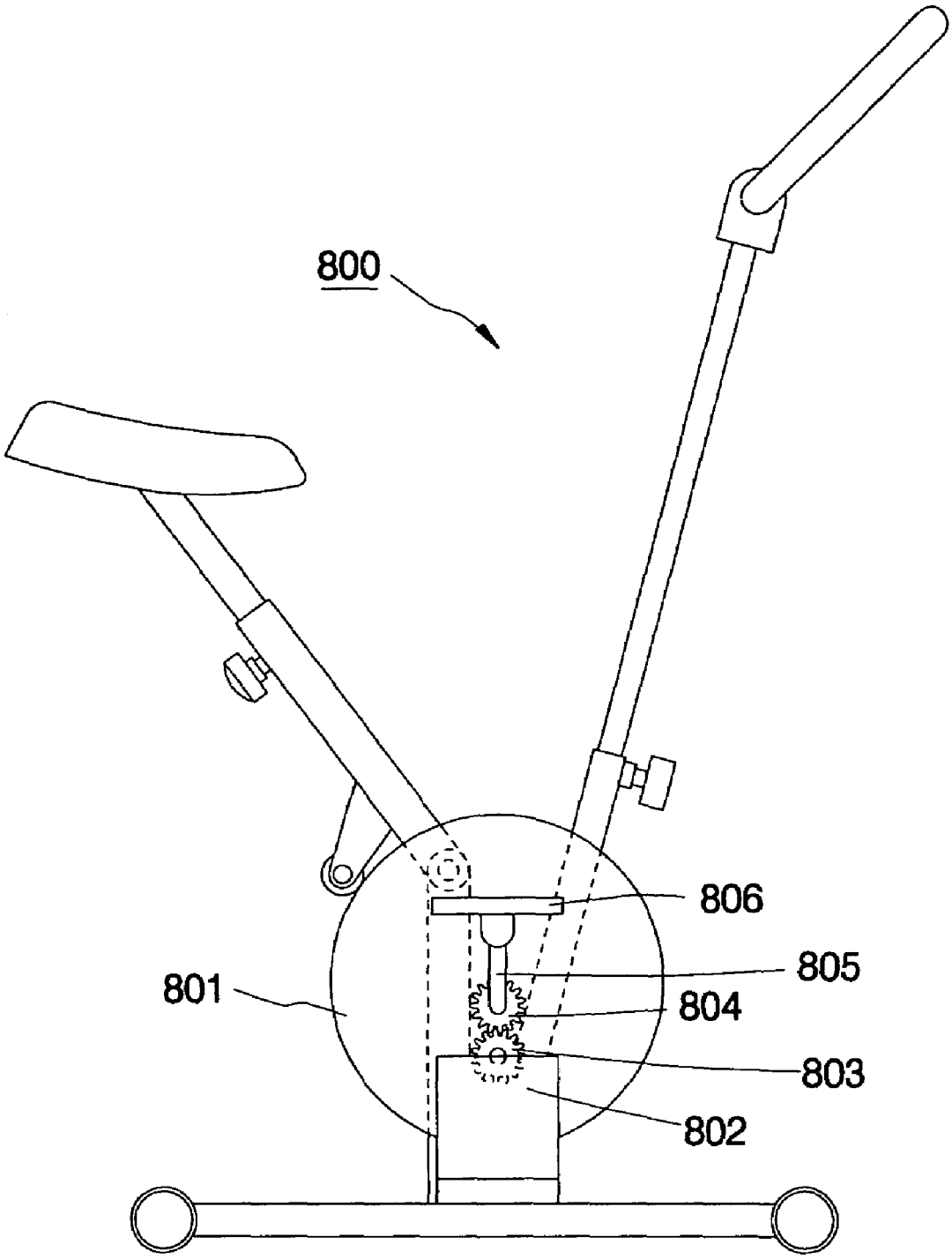
FIG. 11 is a side view of an eighth preferred embodiment of the present invention.

Referring to FIG. 11, the exercise bicycle 800 constructed according to an eighth preferred embodiment is different from the aforementioned seventh embodiment in that the driven wheel 801 embodied an eccentric wheel is driven to rotate by a motor 802 and further drives a passive gear 803 in mesh with the an active gear 804 to rotate, and meanwhile, the active gear 804 forces the driven wheel 801, the crank 805, and the pedal 806 to rotate together.

What is claimed is:

1. An exercise bicycle comprising:

a frame having a base, a driven member having an end pivotably connected to said base, and a contacting portion positioned on said driven member; and a driven wheel stationarily rotatably connected to said base and having a rolling face contacted with the contacting portion of the driven member for driving said driven member to reciprocatingly pivot to said base when the driven wheel is driven to rotate; a driving wheel stationarily rotatably connected to said base, a crank connected at an end thereof to the driving wheel, a pedal connected to the other end of the crank for the user's leg pedaling, a saddle connected to the other end of the driven member, and a belt; wherein said driven wheel is a cam having a cylindrical axial neck protruded at a side thereof; said belt running on said driving wheel and said axial neck of the driven wheel; said contacting portion is formed of a roller that is rotatably connected to said driven member.

2. The exercise bicycle as defined in claim 1, wherein said driven wheel is an eccentric wheel having a circular outer edge forming the rolling face; said roller engages against said rolling face of said eccentric wheel.

3. The exercise bicycle as defined in claim 1, wherein said driven wheel is a discoid cam having an outer edge forming said rolling face; said roller engages against said rolling face of said discoid cam.

4. The exercise bicycle as defined in claim 1, wherein said driven wheel is a face cam recessed at a side thereof with an annular ditch forming said rolling face; said roller is received in said annular ditch to engage an inner periphery of said annular ditch at an outer edge thereof.

5. The exercise bicycle as defined in claim 1, wherein said driven wheel is a ribbed cam having an annular rib around an outer edge thereof forming said rolling face; said contacting portion is formed of two rollers respectively engaging against an inner periphery and an outer periphery of said annular rib.

6. The exercise bicycle as defined in claim 1, wherein said driven wheel is rotated along with the driving wheel driven by the user's legs pedaling said pedal.

7. The exercise bicycle as defined in claim 1, wherein said driving wheel further comprises an active gear, said exercise bicycle further comprising a motor for driving a passive gear in mesh with said active gear to rotate and further driving said driving wheel and said driven wheel to rotate synchronously.

8. The exercise bicycle as defined in claim 1, wherein said frame comprises a handrail, said handrail being fixedly connected with said driven member at an end thereof.

9. The exercise bicycle as defined in claim 1, the exercise bicycle farther comprising an active gear being coaxially mounted at a side of said driven wheel, a motor driving a passive gear in mesh with said active gear to rotate and further to drive said driven wheel, said crank, and said pedal to rotate.

* * * * *